US007032334B2

(12) United States Patent
Pippins

(10) Patent No.: US 7,032,334 B2
(45) Date of Patent: Apr. 25, 2006

(54) SYSTEM AND METHOD FOR COUPLING EXCAVATION EQUIPMENT COMPONENTS

(75) Inventor: Sherlock K. Pippins, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 10 days.

(21) Appl. No.: 10/856,299

(22) Filed: May 28, 2004

(65) Prior Publication Data

US 2005/0274047 A1 Dec. 15, 2005

(51) Int. Cl.
*E02F 9/28* (2006.01)

(52) U.S. Cl. ..... 37/455

(58) Field of Classification Search ..... 37/446, 37/449, 450, 452, 453, 454, 455, 456; 172/701.1, 172/701.3
See application file for complete search history.

(56) References Cited

U.S. PATENT DOCUMENTS

| | | | | |
|---|---|---|---|---|
| 1,216,290 | A | 2/1917 | Dickson | |
| 1,419,047 | A | 6/1922 | Hanks et al. | |
| 1,845,677 | A | 2/1932 | Mekeel | |
| 1,917,431 | A | 7/1933 | Clark | |
| 2,064,059 | A | 12/1936 | Fellmeth | 37/142 |
| 2,113,420 | A | 4/1938 | Younie | 37/141 |
| 2,618,873 | A | 11/1952 | Hostetter | 37/142 |
| 2,635,366 | A | 4/1953 | Hostetter | 37/142 |
| 2,689,419 | A | 9/1954 | Daniels et al. | 37/142 |
| 2,934,842 | A | 5/1960 | Van Buskirk | 37/142 |
| 3,027,201 | A | 3/1962 | Blazek et al. | 305/58 |
| 3,068,737 | A | 12/1962 | Mewse | 85/5 |
| 3,498,677 | A | 3/1970 | Morrow | 299/102 |
| 3,520,224 | A | 7/1970 | Hensley et al. | 85/8.3 |
| 3,787,132 | A | 1/1974 | Garnett | 403/290 |
| 3,831,298 | A | 8/1974 | Helton et al. | 37/142 A |
| 3,839,805 | A | 10/1974 | Stepe | 37/142 |
| 3,851,982 | A | 12/1974 | See | 403/224 |
| 3,879,867 | A | 4/1975 | Ericson et al. | 37/142 |
| 3,896,569 | A | 7/1975 | Thompson et al. | 37/141 |
| 3,967,399 | A | 7/1976 | Heinold et al. | 37/458 |
| 3,974,579 | A | 8/1976 | Black et al. | 37/141 |
| 3,982,339 | A | 9/1976 | Nilsson | 37/141 |
| 4,067,657 | A | 1/1978 | Kaariela | 403/317 |
| 4,120,105 | A | 10/1978 | Stepe | 37/142 |

(Continued)

FOREIGN PATENT DOCUMENTS

AU 716828 6/1997

(Continued)

OTHER PUBLICATIONS

Notification of Transmittal of the International Search Report and the Written Opinion for International Application No. PCT/US2004/014631, filed May 10, 2004 (15 pages), Oct. 18, 2004.

(Continued)

*Primary Examiner*—Robert E Pezzuto
(74) *Attorney, Agent, or Firm*—Baker Botts L.L.P.

(57) ABSTRACT

In accordance with a particular embodiment of the present invention, a system for coupling excavation equipment components includes a pin assembly configured to couple a first tool body to a second tool body. The pin assembly is configured to be received at least partially within a pin bore of the second tool body. The pin assembly includes an elongate insert having a first end and a second end. The insert defines a plug bore extending at least partially through the insert from the first end. The pin assembly also includes a first plug that is configured to be received at least partially within the first end of the insert.

44 Claims, 3 Drawing Sheets

U.S. PATENT DOCUMENTS

| | | | | |
|---|---|---|---|---|
| 4,233,761 | A | 11/1980 | Ryerson | 37/142 |
| 4,247,147 | A | 1/1981 | Rettkowski | 299/10 |
| 4,271,615 | A | 6/1981 | Jones | 37/142 A |
| 4,282,665 | A | 8/1981 | Fletcher et al. | 37/142 |
| 4,326,348 | A | 4/1982 | Emrich | 37/142 |
| 4,335,532 | A | 6/1982 | Hahn et al. | 37/142 |
| 4,404,760 | A | 9/1983 | Hahn et al. | 37/459 |
| 4,414,764 | A | 11/1983 | Johansson et al. | 37/141 |
| 4,433,496 | A | 2/1984 | Jones et al. | 37/141 |
| 4,446,638 | A | 5/1984 | Novotny et al. | 37/142 |
| 4,481,728 | A | 11/1984 | Mulder et al. | 37/142 |
| 4,587,751 | A | 5/1986 | Sjogren et al. | 37/142 |
| 4,662,762 | A | 5/1987 | Schwarz | 384/25 |
| 4,663,867 | A | 5/1987 | Hahn et al. | 37/142 |
| 4,716,667 | A | 1/1988 | Martin | 37/142 |
| 4,727,663 | A | 3/1988 | Hahn | 37/142 |
| 4,782,607 | A | 11/1988 | Frisbee et al. | 37/141 |
| 4,823,487 | A | 4/1989 | Robinson | 37/142 |
| RE33,042 | E | 9/1989 | Emrich | 37/142 |
| 4,895,459 | A | 1/1990 | Werner | 384/43 |
| 4,932,145 | A | 6/1990 | Reeves, Jr. | 37/141 |
| 4,941,758 | A | 7/1990 | Osawa | 384/40 |
| 5,009,017 | A | 4/1991 | Diekevers et al. | 37/142 |
| 5,074,062 | A | 12/1991 | Hahn et al. | 37/142 |
| 5,081,774 | A | 1/1992 | Kuwano | 137/142 |
| 5,088,214 | A | 2/1992 | Jones | 37/141 |
| 5,111,600 | A | 5/1992 | Lukavich et al. | 37/141 |
| 5,152,088 | A | 10/1992 | Hahn | 37/142 |
| 5,172,501 | A | 12/1992 | Pippins | 37/142 |
| 5,181,780 | A | 1/1993 | Morita | 384/8 |
| 5,233,770 | A | 8/1993 | Robinson | 37/456 |
| 5,263,351 | A | 11/1993 | Berg, III | 72/208 |
| 5,297,873 | A | 3/1994 | Komiya | 384/45 |
| 5,337,495 | A | 8/1994 | Pippins | 37/453 |
| 5,361,520 | A | 11/1994 | Robinson | 37/458 |
| 5,410,826 | A | 5/1995 | Immel et al. | 37/457 |
| 5,423,138 | A | 6/1995 | Livesay et al. | 37/456 |
| 5,435,084 | A | 7/1995 | Immel | 37/398 |
| 5,452,529 | A | 9/1995 | Neuenfeldt et al. | 37/455 |
| 5,469,648 | A | 11/1995 | Jones et al. | 37/457 |
| 5,484,210 | A | 1/1996 | Gallone | 384/49 |
| 5,491,915 | A | 2/1996 | Robinson | 37/458 |
| 5,638,621 | A | 6/1997 | Keech et al. | 37/446 |
| 5,709,043 | A | 1/1998 | Jones et al. | 37/458 |
| 5,784,813 | A | 7/1998 | Balassa et al. | 37/455 |
| 5,802,795 | A | 9/1998 | Myers et al. | 52/426 |
| 5,868,518 | A | 2/1999 | Chesterfield et al. | 403/379 |
| 5,909,962 | A | 6/1999 | Livesay et al. | 37/456 |
| 5,926,982 | A | 7/1999 | Keech et al. | 37/455 |
| 5,937,549 | A | 8/1999 | Bender et al. | 37/455 |
| 5,937,550 | A | 8/1999 | Emrich | 37/458 |
| 5,947,209 | A | 9/1999 | Halford et al. | 172/772.5 |
| 5,983,534 | A | 11/1999 | Robinson et al. | 37/459 |
| 5,992,063 | A | 11/1999 | Mack | 37/450 |
| 6,000,153 | A | 12/1999 | Sollami | 37/453 |
| 6,013,078 | A | 1/2000 | Lin | 606/72 |
| 6,018,896 | A | 2/2000 | Adamic | 37/456 |
| 6,052,927 | A | 4/2000 | Pippins | 37/454 |
| 6,092,958 | A | 7/2000 | Gale | 403/378 |
| 6,108,950 | A | 8/2000 | Ruvang et al. | 37/452 |
| 6,119,378 | A | 9/2000 | Pippins | 37/454 |
| 6,151,812 | A | 11/2000 | Bierwith | 37/455 |
| 6,209,238 | B1 | 4/2001 | Ruvang | 37/455 |
| 6,247,255 | B1 | 6/2001 | Clendenning | 37/452 |
| 6,301,810 | B1 | 10/2001 | Fidler | 37/458 |
| 6,374,521 | B1 | 4/2002 | Pippins | 37/456 |
| 6,439,796 | B1 | 8/2002 | Ruvang et al. | 403/157 |
| 6,467,203 | B1 | 10/2002 | Pippins | 37/452 |
| 6,467,204 | B1 | 10/2002 | Creighton et al. | 37/456 |
| 6,502,336 | B1 | 1/2003 | Pippins | 37/458 |
| 6,574,892 | B1 | 6/2003 | Creighton | 37/456 |
| 2002/0000053 | A1 | 1/2002 | Adamic et al. | 37/456 |
| 2002/0010994 | A1 | 1/2002 | Hess | 29/426.5 |
| 2002/0023375 | A1 | 2/2002 | Pippins | 37/457 |

FOREIGN PATENT DOCUMENTS

| | | | |
|---|---|---|---|
| AU | 199911346 | A1 | 7/2000 |
| AU | 200154094 | A1 | 1/2002 |
| CA | 2161505 | A1 | 4/1997 |
| EP | 0 717 204 | A1 | 12/1995 |
| EP | 1156164 | | 11/2001 |
| GB | 303708 | | 1/1929 |
| GB | 364531 | | 4/1931 |
| GB | 836167 | | 6/1960 |
| WO | WO 95/01481 | | 1/1995 |

OTHER PUBLICATIONS

"Dragline Products—Hensley Style" (eleven pages), no date.

"Keech Castings Australia PTY. Limited," Aug. 31, 1995 (one page).

"Maglok® System, " *Quality Steel Foundries Ltd*, no date.

"Posilok® Tooth Systems" (one page), no date.

"Torqlok® System," *Quality Steel Foundries Ltd.* (one page), no date.

"Mining Vertalok® Adapters for Shovel Dippers," ©1992 ESCO Corporation. (4 pages).

International Search Report for Trinity Industries, Inc., regarding International application No. PCT/US 02/27402 signed by Paul Faux (8 pages), Nov. 12, 2002.

PCT International Search Report in International Application No. 03/20075, dated Jun. 25, 2003, 8 pages.

PCT International Search Report in International Application No. 03/01664, dated Mar. 15, 2004, 6 pages.

SYSTEM AND METHOD FOR COUPLING EXCAVATION EQUIPMENT COMPONENTS

TECHNICAL FIELD OF THE INVENTION

The present invention relates generally to replaceable excavation equipment components that are exposed to high wear and repeated shock loading such as removable teeth and adapter assemblies used on excavating machines, and more particularly, to a system and method for coupling excavation equipment components.

BACKGROUND OF THE INVENTION

Digging and leveling apparatus such as drag lines, back hoes, front-end loaders, bulldozers, and the like often use replaceable teeth and adapter assemblies which are mounted on a tooth horn to provide sacrificial parts that are exposed to the repeated shock loading and high wear occasioned by digging operations. In such systems, adapter assemblies may include a wedge-shaped adapter that mounts directly on the tooth horn of a bucket, shovel or alternative digging or scraping mechanism of the equipment. The wedge-shaped adapter is frontally seated on and coupled with the tooth horn and is configured to receive a removable tooth. Removable pin assemblies may be used to couple the removable adapter to the horn and the removable tooth to the adapter. Such pin assemblies may also be used to couple shrouds and other wearable parts to the horn, adapter, or tooth.

SUMMARY OF THE INVENTION

The present invention includes a system and method for coupling excavation equipment components that substantially eliminates or reduces disadvantages or problems associated with previously developed fastening methods and apparatus. In particular, the present invention provides a system and method for coupling the components of an excavation tool, using a pin assembly.

In accordance with a particular embodiment of the present invention, a system for coupling excavation equipment components includes a pin assembly configured to couple a first tool body to a second tool body. The pin assembly is configured to be received at least partially within a pin bore of the second tool body. The pin assembly includes an elongate insert having a first end and a second end. The insert defines a plug bore extending at least partially through the insert from the first end. The pin assembly also includes a first plug that is configured to be received at least partially within the first end of the insert.

In accordance with another embodiment of the present invention, the system includes an insert having a shape that corresponds to a shape of the pin bore. In accordance with this embodiment, the shape of the insert may be a geometric figure having a number of sides of equal width.

In accordance with another embodiment of the present invention, the first plug of the system includes a generally cylindrical, tapered surface that corresponds to a tapered surface of the insert adjacent the plug bore. In accordance with this embodiment, tightening of the first plug forces the tapered surface of the first plug along the tapered surface of the insert, to at least partially prevent overtightening of the first plug beyond an installed position.

Technical advantages of particular embodiments of the present invention include a system and method for securely coupling various components of an excavation tool using a pin assembly. For example, the system and method may be used to securely couple a removable adapter with a tooth horn. The pin assembly may also be used to securely couple a removable tooth with an adapter or to couple the adapter or horn with other removable excavation components. The pin assembly prevents inadvertent decoupling of the tools but allows for easy decoupling in the field by an operator. For example, the decoupling of the adapter from the horn and the removable tooth from the adapter may be accomplished by using simple hand and/or power tools.

Another technical advantage of particular aspects of the present invention includes a system and method that substantially eliminates rotation of the pin assembly when the components are assembled. Another technical advantage of particular aspects of the present invention includes a system and method that prevents overtightening of the pin assembly beyond an installed position.

Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Figure 1A:
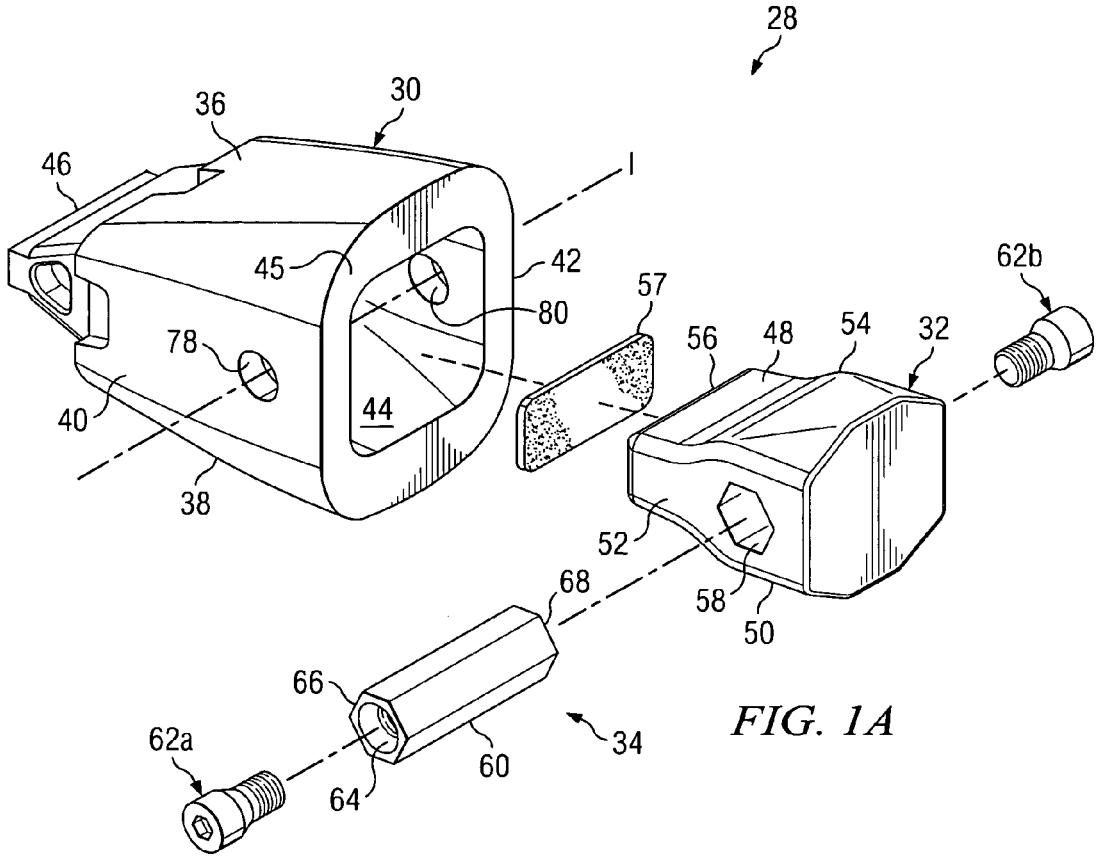
FIG. 1 is an isometric exploded view of excavation tool components that may be coupled using a pin assembly according to a particular embodiment of the present invention.
Figure 1B:
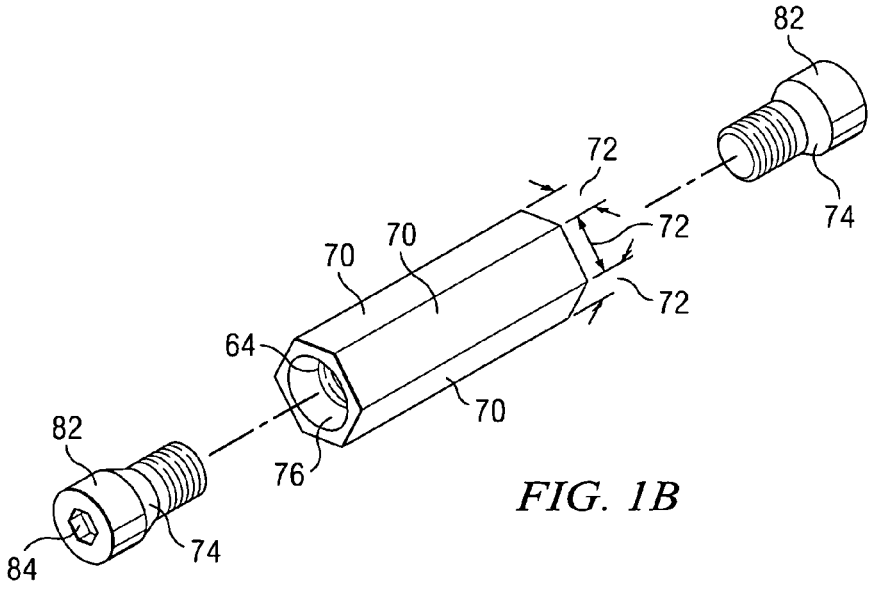

FIGS. 1A and 1B illustrate an excavation tool 28 that includes one or more removably coupled tool bodies. Accordingly, a first tool body 30 may be removably coupled with a second tool body 32 using pin assembly 34. Although first tool body 30 is illustrated as an adapter and second tool body 32 is illustrated as a tooth horn for illustration purposes, it is generally recognized that pin assembly 34 may be used to couple other excavation equipment components found on a bucket, shovel or other excavating machine. Accordingly, first tool body 30 may instead comprise a tooth or shroud and second tool body 32 may instead comprise an adapter to be fitted on a tooth horn. Pin assembly 34 may be used to couple any combination of such excavation components.

During excavation and/or mining operations, first tool body 30 is subject to significant wear and tear. Extreme shock loading is experienced as removable first tool body 30 impacts adjacent earth, rocks, and other abrasive material. Therefore, it is desirable to make first tool body 30 readily replaceable with a new or reconditioned component of similar or identical configuration. Otherwise, second tool body 32, or buckets, shovels or other excavation equipment would need to be replaced more frequently, increasing equipment and labor costs associated therewith. By providing a removable first tool body 30 at a location upon second tool body 32 that would otherwise experience the most wear, the service life of such equipment is prolonged by replacing selected parts associated with the excavation equipment.

In order to prevent excessive wear of second tool body 32, for example, first tool body 30 is coupled with and at least partially conceals and/or protects second tool body 32 from abrasive materials during excavation. First tool body 30 includes first and second tapered surfaces 36 and 38 and first and second sides 40 and 42. First and second sides 40 and 42 may be generally parallel to one another. First and second tapered surfaces 36 and 38 and first and second sides 40 and 42 cooperate to define an opening 44 at first end 45. Opening 44 converges toward a second end 46 of first tool body 30. Opening 44 is configured to receive second tool body 32 at least partially therein. Accordingly, opening 44 generally corresponds to the shape of second tool body 32 such that first tool body 30 may be slidably mounted on second tool body 32 and held in place using pin assembly 34.

As discussed above, second tool body 32 is configured to be received in opening 44. In particular embodiments, second tool body 32 may include first and second tapered surfaces 48 and 50 that correspond generally with first and second tapered surfaces 36 and 38 of first tool body 30. Accordingly, first and second tapered surfaces 48 and 50 may converge toward a first end 56 of second tool body 32. Second tool body 32 also includes first and second sides 52 and 54 that may be generally parallel to one another. When first and second tool bodies 30 and 32 are coupled, first and second sides 52 and 54 of second tool body 32 may be disposed adjacent to first and second sides 40 and 42 of first tool body 30.

The configuration of first tool body 30 and second tool body 32 may vary significantly within the teachings of the present invention. For example, although first tool body 30 is described as having first and second tapered surfaces 36 and 38, other embodiments may include only one tapered side. Alternatively, first tool body 30 may not have any tapered sides. Furthermore, although first tool body 30 is described as having first and second sides 40 and 42 that are generally parallel to one another, in other embodiments one or both of first and second sides 40 and 42 may be tapered such that first and second sides 40 and 42 may not be parallel to one another. Such alterations may also be made to second tool body 32 within the teachings of the present invention. In general, the configurations of the excavation components are selected to receive and provide protection from excessive wear caused during excavation operations.

Second tool body 32 also includes a pin bore 58 that originates at first side 52 of second tool body 32 and extends at least partially through second tool body 32. In the illustrated embodiment, pin bore 58 extends through second tool body 32 from first side 52 to second side 54. Pin bore 58 is configured to at least partially receive pin assembly 34 through first end 52 and/or second end 54. Pin bore 58 and pin assembly 34 cooperate to provide for the simplified installation and/or removal of first tool body 30 from second tool body 32. Accordingly, first tool body 30 may be installed, removed or replaced by an operator in the field, quickly and easily. Additionally, the configuration of pin bore 58 and pin assembly 34 prevent shifting of first tool body 30, with respect to second tool body 32, during use.

Pin assembly 34 includes an elongate insert 60. Insert 60 is configured to be at least partially received within pin bore 58. Accordingly, the shape and size of pin bore 58 corresponds generally to the shape and size of insert 60. The configurations of pin bore 58 and insert 60 may vary significantly within the teachings of the present invention. In particular embodiments, insert 60 may be of a geometric shape that includes a number of sides 70 of equal width 72. Because the shape of pin bore 58 corresponds with the shape of insert 60, pin bore 58 may also be of a geometric shape that includes a number of sides of equal width. In particular embodiments insert 60 and pin bore 58 may each be of a shape having between three and eight sides 70. In the particular embodiment illustrated in FIGS. 1A and 1B, insert 60 and pin bore 58 each have six sides 70. In other words, the shapes of insert 60 and corresponding pin bore 58 are hexagonal. The illustrated shape, however, is for example purposes only. It is generally recognized that insert 60 and pin bore 58 may be of any suitable geometric shape. Accordingly, some alternative example embodiments for insert 60 are described in more detail with regard to FIGS. 2 and 3.

Pin assembly 32 also includes one or more plugs 62 configured to cooperate with a plug bore 64. Plug bore 64 extends at least partially through insert 60 and is configured to at least partially receive one or more plugs 62 therein. In the illustrated embodiment, plug bore 64 extends entirely through insert 60 from a first end 66 to a second end 68. Accordingly, plug bore 64 is configured to receive a first plug 62*a* at first end 66 and a second plug 62*b* at a second end 68. It is recognized, however, that plug bore 64 need not extend entirely through insert 60. Where plug bore 64 does not extend entirely through insert 60, a single plug 62 may be used.

Because plugs 62 are received in plug bore 64 of insert 60, the shape of plugs 62 corresponds generally to the shape of plug bore 64. Thus, where plug bore 64 is substantially cylindrical, plugs 62 are also substantially cylindrical. In the illustrated example, plugs 62 include a generally cylindrical, tapered surface 74 that corresponds to a tapered surface 76 of insert 60. Tightening of a plug 62 forces tapered surface 74 of plug 62 along tapered surface of insert 60 to at least partially prevent overtightening of plug 62 beyond an installed position. The configuration of plugs 62 and corresponding plug bore 64 may vary significantly, however, within the teachings of the present invention.

In operation, plugs 62 and insert 60 cooperate to couple first tool body 30 to second tool body 32 in the installed position. As such, sides 46 and 48 of first tool body 32 include respective openings 78 and 80, which are configured to receive a portion of plugs 62 at least partially therethrough. The respective positions of openings 78 and 80 upon sides 46 and 48 are selected to align with first and second ends 64 and 66 of plug bore 58, respectively. In other words, when first tool body 30 is properly positioned upon second tool body 32, plug bore 58 and openings 78 and 80 are aligned such that an imaginary central longitudinal axis I extends through openings 78 and 80 and insert 60. In the installed position, plugs 62 are inserted through openings 78 and 80 and into at least a portion of plug bore 58 to couple first tool body 30 to second tool body 32. In the correct installed position, plugs 62 may be recessed from sides 40 and 42 of first tool body 30 by approximately 0.125 to 1.000 inches. In particular embodiments, plugs 62 may be recessed from sides 40 and 42 of first tool body 30 from 0.25 to 0.5 inches.

In the illustrated embodiment, plugs 62 each include a head 82. Head 82 may be outfitted with a groove 84 to enable the removal and replacement of plugs 62 through openings 78 and 80. As will be described in further detail with regard to FIG. 3, each plug 62 may include one or more threaded surfaces that engage with insert 60 and/or first tool body 30. Plugs 62 operate to seal plug bore 64 and protect it from ambient environment, fluids, and debris that may be encountered during use of the excavation equipment. Plugs 62 also allow for the easily decoupling of first and second tool bodies 30 and 32 in the field. In order to decouple first tool body 30 and second tool body 32, plugs 62 having threads may be rotated and removed from plug bore 64 using head 82 and a suitable tool.

In the illustrated embodiment of FIG. 1A, excavation tool 28 includes an elastomeric member 57 that is generally positioned between first tool body 30 and second tool body 32, when excavation tool 28 is in the assembled position. When installed, elastomeric member 57 provides an interface between the interior portion of first tool body 30 and first end 56 of second tool body 32. Elastomeric member 57 alleviates "slack" between first tool body 30 and second tool body 32. This alleviates or eliminates metal to metal contact between first end 56 of second tool body 32 and first tool body 30, that can lead to premature wear of such components.

Elastomeric member 57 may be provided in one of a number of different materials, including rubber, plastic, or other deformable materials that generally exhibit memory. In other words, such material may be compressed and yet return to its initial shape. Elastomeric member 57 may be coupled with, or be integral first body 30 or second body 32, in order to simplify installation. For example, elastomeric member 57 may be coupled with the interior portion of first tool body 30 (e.g., using an adhesive material). Thus, when second tool body 32 is coupled with first tool body 30 using insert 60, the holes of these components may be configured such that elastomeric member 57 will be at least slightly compressed to remove any slack between such components.

Figure 2:
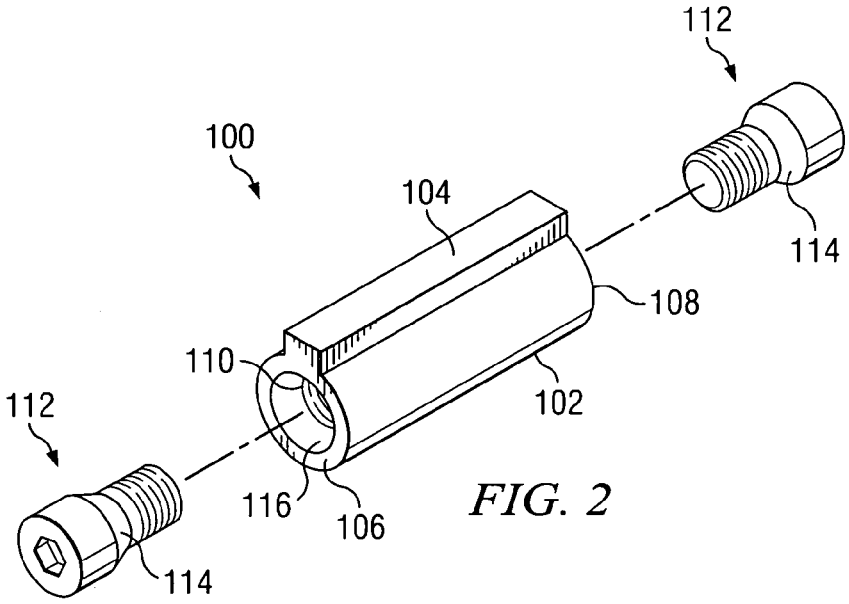
FIGS. 2–3 are isometric views of a pin assembly in accordance with particular embodiments of the present invention.
Figure 3:
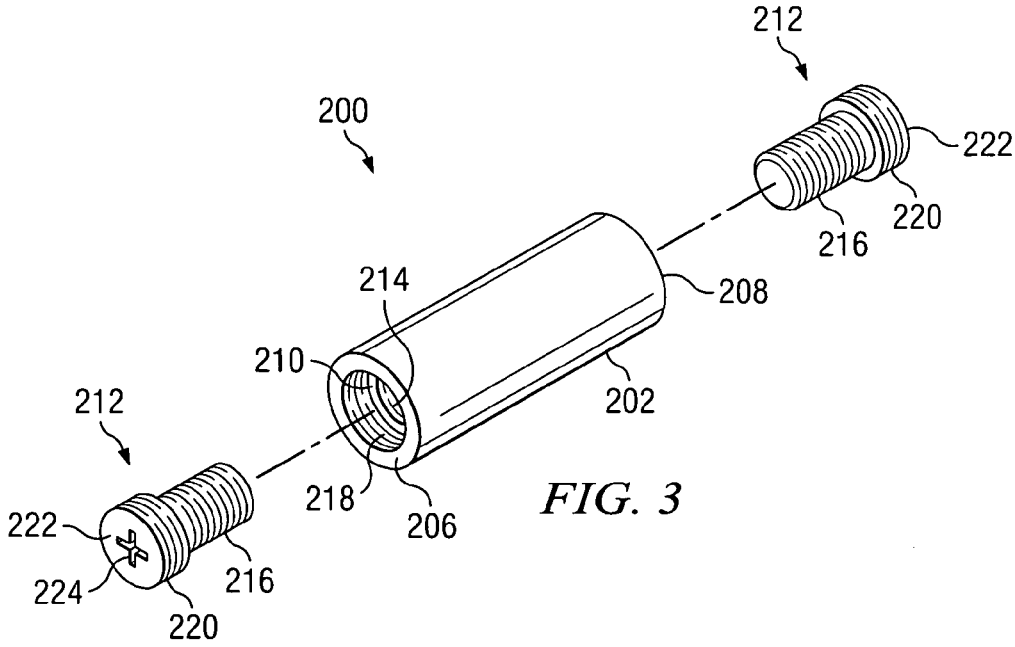

FIGS. 2 and 3 illustrate alternative configurations of pin assembly 34. Specifically, FIG. 2 illustrates a pin assembly 100 that includes a substantially cylindrical insert 102 having a non-rotation tab 104. Similar to insert 60 described above, insert 100 is configured to be at least partially received within pin bore 58 of second tool body 32. Accordingly, where insert 102 is substantially cylindrical and includes non-rotation tab 104, the shape and size of pin bore 58 is also substantially cylindrical and includes a recess that corresponds to non-rotation tab 104 (not shown in FIG. 1).

In the illustrated embodiment non-rotation tab 104 extends the full length of insert 102 from a first end 106 of insert 102 to a second end 108 of insert 102. It is generally recognized, however, that non-rotation tab 104 need not extend the entire length of insert 102. Rather non-rotation tab 104 may originate at first end 106 and extend some suitable distance toward second end 108 without reaching second end 108. Non-rotation tab 104 operates to eliminate the rotation of insert 102 in the installed position in plug bore 58. Non-rotation tab 104 also operates to provide strength to pin assembly 100.

Pin assembly 100 also includes a plug bore 110 that is configured to cooperate with one or more plugs 112. Plug bore 110 and plugs 112 may be configured similarly to plug bore 64 and plugs 62, respectively, as described above with regard to FIG. 1. For example, plugs 112 may include a generally cylindrical, tapered surface 114 that corresponds to a tapered surface 116 of insert 102. Tightening of a plug 112 into plug bore 110 forces tapered surface 114 of plug 112 along tapered surface 116 of insert 102 to at least partially prevent overtightening of plug 112 beyond an installed position.

FIG. 3 illustrates a pin assembly 200 that includes a cylindrical insert 202. Similar to insert 102 described above, insert 202 is configured to be at least partially received within pin bore 58 of second tool body 32. Accordingly, where insert 202 is cylindrical, pin bore 58 is also of a similar cylindrical shape and size.

Pin assembly 200 also includes a plug bore 210 that is configured to cooperate with one or more plugs 212. As illustrated, plug bore 210 extends throughout the entire length of insert 202 from a first end 206 of insert 202 to a second end 208 of insert 202. Generally, plug bore 210 and plugs 212 may be configured similarly to plug bore 64 and plugs 62, respectively, as described above with regard to FIG. 1. To effect the coupling of plugs 212 and insert 202, however, plugs 212 and plug bore 210 are each outfitted with one or more corresponding threads. For example, insert 202 includes a threaded surface 214 that interacts with a threaded surface 216 of plug 212. When plug 212 is in an installed position in plug bore 210, threaded surface 214 and threaded surface 216 engage one another such that plug 212 may be removably coupled to insert 202. Accordingly, plug 212 may be removed from insert 202 by rotating plug 212 with respect to insert 202. When installed, plugs 212 operate to conceal and/or protect pin assembly 200 from abrasive materials during excavation operations.

In the illustrated embodiment, insert 202 also includes a threaded surface 218 that is configured to interact with a threaded surface 220 of a head 222 of plug 212. Threaded surfaces 218 and 220 may cooperate to hold plug 212 in place within insert 202 when plug 212 is in the installed position. Threaded surfaces 218 and 220 may be in addition to or as an alternative to threaded surfaces 214 and 216, respectively.

As described above, at least a portion of heads 222 of plugs 212 may protrude from the first and second ends 206 and 208 of insert 202. As such, threaded surfaces 220 of plugs 212 may engage corresponding threaded surfaces within openings 78 and 80 of first tool body 30. In the installed position, threaded surfaces 220 may operate to secure first tool body 30 to second tool body 32. Additionally, threaded surfaces 220, when engaged with corresponding threaded surfaces within openings 78 and 80, may operate to eliminate the rotation of pin assembly 200 within pin bore 58.

Heads 222 may also include at least one groove 224, which is configured to cooperate with a tool to extend or retract plugs 212 to and from the installed position within insert 202. Groove 224 may be configured to cooperate with simple hand tools, such as a screwdriver or power drill head. Accordingly, groove 224 may include a standard or Phillips head-type screw receptacle. In other embodiments, groove 224 may comprise a protrusion configured to cooperate with tools other than those described above. For example, head 222 may include a fastener head configuration in order to cooperate with various hand or power (impact) wrenches. The specific configuration of head 222 may vary significantly within the teachings of the present invention. The configuration is generally selected to cooperate with one or more hand or power tools to allow for the installation or removal of pin assembly 202 from pin bore 58 of second tool body 32.

Figure 4:
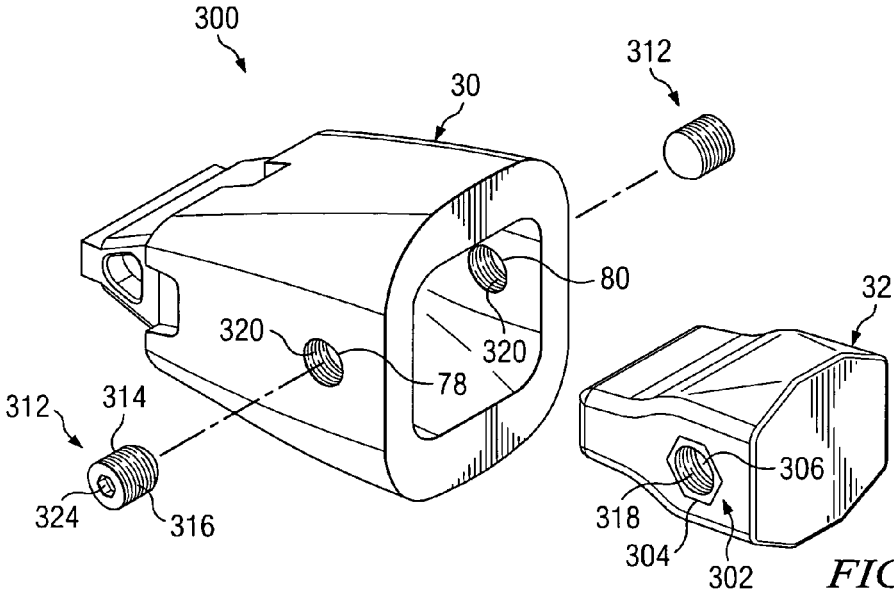
FIG. 4 is an isometric exploded view of excavation tool components that may be coupled using a pin assembly according to a particular embodiment of the present invention.

FIG. 4 illustrates excavation tool 300 that includes one or more tool bodies that are removably coupled to one another using a pin assembly 302. In the illustrated example, pin assembly 302 includes an insert 304 that is shown in the installed position within pin bore 58. Insert 304 may have any combination of the characteristics that were described above with regard to inserts 60, 102, and 202 of FIGS. 1, 2, and 3, respectively. For example, insert 304 is illustrated as having a shape that substantially prevents the rotation of insert 304 within pin bore 58. Additionally, insert 304 is shown to extend through second tool body 32 from first side 52 to second side 54. Accordingly, plug bore 306 may also extend entirely within insert 304 from a first end corresponding with first side 52 of second tool body 32 to a second end corresponding with second side 54 of second tool body 32.

Plug bore 306 is configured to at least partially receive plugs 312. Plugs 312 comprise a disc or plate having an edge 314 that includes a threaded surface 316. When plugs 312 are in the installed position, threaded surfaces 316 may cooperate with threaded surfaces 318 located in plug bore 306 of insert 304. Similar to the threaded surfaces described with regard to FIG. 3, threaded surfaces 316 and 318 may cooperate to engage one another such that plugs 312 may be removably coupled with insert 304 when plugs 312 are in the installed position in plug bore 306. Accordingly, plugs 312 may be removed from insert 304 by rotating plugs 312 with respect to insert 304.

As described above, at least a portion of plugs 312 may protrude from insert 202 when plugs 312 are in an installed position. As such, threaded surfaces 316 of plugs 312 may engage corresponding threaded surfaces 320 within openings 78 and 80 of first tool body 30. Threaded surfaces 316 and 320 may cooperate to secure first tool body 30 to second tool body 32 when first tool body 30 is slidably mounted on second tool body 32. Additionally, threaded surfaces 316, when engaged with corresponding threaded surfaces 320 within openings 78 and 80, may operate to eliminate the rotation of pin assembly 302 within pin bore 58. Similar to head 222 described above with regard to FIG. 3, plug 312 may also include at least one groove 324, which is configured to cooperate with a tool to allow for the installation or removal of pin assembly 304 from pin bore 58 of second tool body 32.

In the illustrated embodiment, threaded surface 316 is long enough to engage each of threaded surfaces 318 and 320. It will be recognized by those having ordinary skill in the art that threaded surfaces 318 and 320 are optional, and not required. In any particular embodiment, one or both threaded surfaces 318 and 320 may be provided. Furthermore, the length of threaded surface 316 may be adjusted accordingly.

The teachings of the present invention may be used for coupling various excavation, earth moving, and/or mining equipment components. In general, any removable and/or replaceable component will benefit from the fastening and component cooperation techniques disclosed herein. More specifically, removable adapters may be coupled with tooth horns of buckets, shovels, or practically any heavy equipment components in accordance with the present invention. Similarly, ripper shanks may be coupled with various removable components provided to protect the ripper shank and/or prolong the life of the ripper shank. Another example of excavation equipment incorporating aspects of the present invention is described with regard to FIG. 5.

Figure 5:
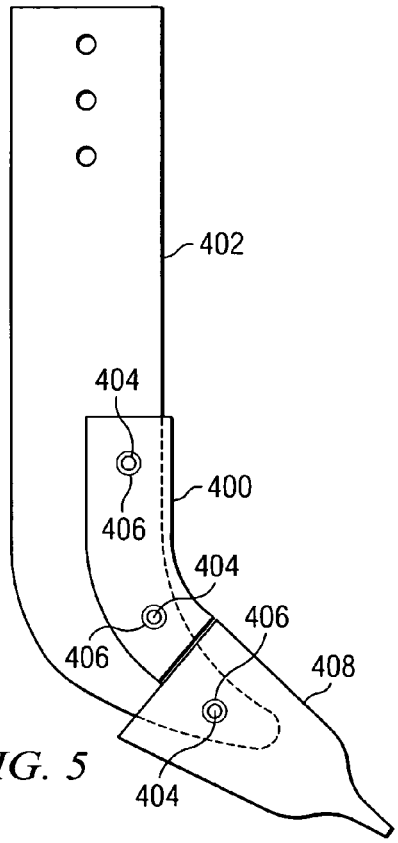
FIG. 5 is a side view of a ripper shank coupled with a removable tooth, and shroud, in accordance with a particular embodiment of the present invention.

FIG. 5 illustrates a shroud 400 coupled with a shank 402 of an excavating machine part. Shank 402 may be referred to as a "ripper shank." For the purposes of this specification, a shank is a type of adapter that may be coupled with various excavation equipment components, and may receive one or more removable teeth. Shroud 400 provides protection to shank 402 when the excavating machine is in use. The excavating machine may be a dragline used in mining operations or any other machine used for excavating purposes. Shroud 400 is coupled with shank 402 using pin assembly 404, which may be similar in configuration to the pin assemblies described above with regard to FIGS. 1–4. Accordingly, fastening components similar to the pin assemblies described herein may be used to couple shroud 400 with shank 402. Similarly, such pin assemblies may be used to couple shank 402 with the excavation equipment component.

Pin assemblies 404 may be inserted through openings 406, into an internal bore through shank 402, and extend at least partially into openings 406 formed in shroud 400. A plug like those described above, may be used to secure pin assembly 404 within shroud 400, to prevent lateral movement of pin assemblies 404. Removable tooth 408 is also coupled with shank 400 using pin assembly 404. For purposes of this specification, shroud 400 may be considered a removable tooth, which protects one end of shank 402. As discussed above, the teachings of the present invention may be used to removably couple practically any components. Removable tooth 408, shank 402, and shroud 400 are described and shown herein, for illustrative purposes.

Shroud 400 and tooth 408 are used to protect shank 402 from the abrasive environment encountered during excavation. Accordingly, shroud 400 is placed at a location upon shank 402 where significant wear and tear is anticipated. By providing a removable shroud 400 and removable tooth 408, wear and degradation of shank 402 is reduced, thereby increasing its overall service life.

Figure 6:
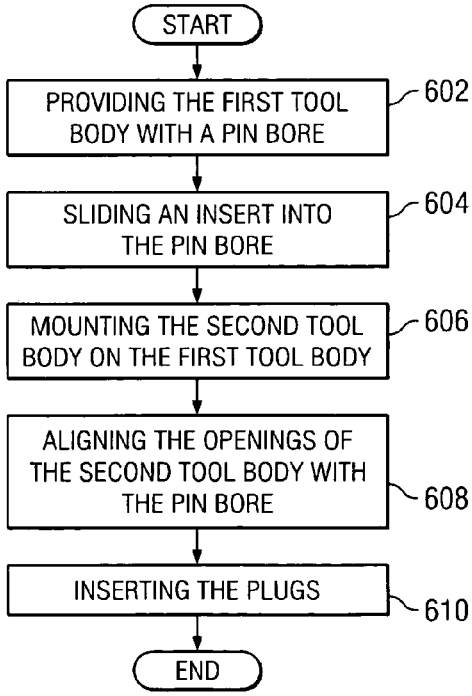
FIG. 6 is a flowchart illustrating a method for assembling the components of an excavation tool using a pin assembly in accordance with a particular embodiment of the present invention.

FIG. 6 is a flowchart illustrating method for assembling the components of excavation tool 28 using pin assembly 34. At step 602, first tool body 30 is provided. In particular embodiments, first tool body 30 may have a pin bore 58 that extends at least partially through first tool body 30 from a first side 52. Insert 60 is slid into pin bore 58 at step 604. In particular embodiments, insert 60 may extend through first tool body 30 from first side 52 to second side 54 when insert 60 is in the installed position. At step 606, first tool body 30 is slidably mounted on second tool body 32. In order to mount first tool body 30 upon second tool body 32, first end 56 of second tool body 32 is slid into opening 44 of first tool body 30 until first end 56 is proximate to first end 46 of first tool body 30. In the installed position, openings 78 and 80 of first tool body 30 are aligned with insert 60 in pin bore 58 of second tool body 32 at step 608. Plugs 62 are inserted into openings 78 and 80 at step 610. In the installed position, at least a portion of plugs 62 extend into plug bore 54 of insert 60.

In particular embodiments, each plug 62 may include at least one threaded surface 216 that corresponds to threaded surfaces 214 of insert 60. When engaged, threaded surfaces 214 and 216 may operate to couple first tool body 30 to second tool body 32. Accordingly, the step of inserting plugs 62 into openings 78 and 80 may include using a screw driver or other tool to rotate plugs 62 relative to insert 60 in pin bore 58. In particular embodiments, the shape of insert 60 and corresponding pin bore 58 may prevent the rotation of insert 60 within pin bore 58 as plugs 62 are being inserted and tightened. For example, the shape of insert 60 and corresponding pin bore 58 may be that of a geometric figure having a number of sides 70 of equal width 72. In particular embodiments, the number of sides 70 may be between three and eight, and may preferably be six. Alternatively, insert 60 and corresponding pin bore 58 may each be of a substantially cylindrical shape and include a tab 104 configured to eliminate rotation of insert 60 in pin bore 58.

In particular embodiments, plugs 62 may include tapered surfaces 74 that correspond to tapered surfaces 76 of insert 60 adjacent plug bore 64. Tightening of plugs 62 may force tapered surfaces 74 along tapered surfaces 76 to at least partially prevent overtightening of plug 62 beyond the installed position. In the correct installed position, plugs 62 may be recessed from first and second sides 40 and 42 of first tool body 30 by approximately 0.125 to 1.000 inches. In particular embodiments, plugs 62 may be recessed from sides 40 and 42 of first tool body 30 from 0.25 to 0.5 inches.

Although embodiments of the invention and their advantages are described in detail, a person skilled in the art could make various alterations, additions, and omissions without departing from the spirit and scope of the present invention as defined by the appended claims.

What is claimed is:

1. A system for coupling excavation equipment components, comprising:

a pin assembly configured to couple an adapter to a horn, the pin assembly configured to be received at least partially within a pin bore of the horn, the pin assembly comprising:

an elongate insert defining a plug bore extending at least partially through the insert from the first end, the insert comprising:

a first end proximate to a first side of the horn;

a second end proximate to a second side of the horn; and a shape corresponding to a shape of the plug bore, the shape of the insert being a geometric figure having six sides of equal width; and a first plug configured to be received at least partially within the first end of the insert, the first plug comprising:

a threaded surface adjacent the plug bore, the threaded surface of the first plug corresponding to a threaded surface of the insert, wherein tightening the first plug couples the adapter to the horn; and a generally cylindrical, tapered surface adjacent the plug bore, the tapered surface of the first plug corresponding to a tapered surface of the insert, wherein tightening of the first plug forces the tapered surface of the first plug along the tapered surface of the insert, to at least partially prevent overtightening of the first plug beyond an installed position.

2. A system for coupling excavation equipment components, comprising:

a pin assembly configured to couple a first tool body to a second tool body, the pin assembly configured to be received at least partially within a pin bore of the second tool body, the pin assembly comprising:

an elongate insert comprising a first end and a second end, the insert defining a plug bore extending at least partially through the insert from the first end;

a first plug configured to be received at least partially within the first end of the insert.

3. The system of claim 2, wherein a shape of the insert corresponds to a shape of the pin bore, the shape of the insert being a geometric figure having a number of sides of equal width.

4. The system of claim 3, wherein the number of sides is between three and eight.

5. The system of claim 3, wherein the number of sides is six.

6. The system of claim 2, wherein a generally cylindrical, tapered surface of the first plug corresponds to a tapered surface of the insert adjacent the plug bore, wherein tightening of the first plug forces the tapered surface of the first plug along the tapered surface of the insert, to at least partially prevent overtightening of the first plug beyond an installed position.

7. The system of claim 2, wherein the plug bore extends through the insert from the first end to the second.

8. The system of claim 7, further comprising:

a second plug configured to be received at least partially within the second end of the insert.

9. The system of claim 2, wherein a shape of the insert corresponds to the shape of the plug bore, the shape of the insert being generally cylindrical.

10. The system of claim 9, wherein the insert includes a tab configured to eliminate rotation of the insert in the pin bore.

11. The system of claim 2, wherein a threaded surface of the insert corresponds to a threaded surface of the first plug adjacent the plug bore, wherein tightening the first plug couples the first tool body to the second tool body.

12. The system of claim 2, wherein a threaded surface of the insert corresponds to a threaded surface of the first tool body, wherein tightening the first plug couples the first tool body to the second tool body.

13. The system of claim 2, wherein the first tool body comprises an opening in a side of the first tool body, the opening configured to at least partially receive the first plug, a head of the first plug recessed in the opening of the first tool body from the side when the first plug is in an installed position.

14. The system of claim 13, wherein the head of the first plug is recessed a distance on the order of 0.25 to 0.5 inches.

15. The system of claim 2, wherein the pin bore extends from a first side of the second tool body to a second side of the second tool body, the elongate insert extending from the first side to the second side when the insert is in an installed position.

16. The system of claim 2, wherein the first tool body comprises a removable adapter and the second tool body comprises a horn.

17. The system of claim 2, wherein the first tool body comprises a removable tooth and the second tool body comprises a horn.

18. The system of claim 2, wherein the first tool body comprises a removable sheath and the second tool body comprises a horn.

19. A system for coupling excavation equipment components, comprising:

a pin assembly configured to couple a first tool body to a second tool body, the pin assembly configured to be received at least partially within a pin bore of the second tool body, the pin assembly comprising:

an elongate insert comprising a first end and a second end, the insert defining a plug bore extending at least partially through the insert from the first end;

a first plug configured to be received in a recess of the first tool body, the first plug operable to couple the first tool body to the second tool body.

20. The system of claim 19, wherein the first plug comprises a plate, an edge of the plate disposed adjacent to a contact surface in the recess of the first tool body.

21. The system of claim 20, wherein the edge of the plate comprises a threaded surface configured to engage a threaded surface of the recess of the first tool body.

22. The system of claim 20, wherein the edge of the plate comprises a threaded surface configured to engage a threaded surface of the plug bore.

23. The system of claim 20, wherein the edge of the plate comprises a generally cylindrical, tapered surface, the generally cylindrical, tapered surface of the first plug corresponding to a tapered surface of the insert adjacent the plug bore, wherein tightening of the first plug forces the tapered surface of the first plug along the tapered surface of the insert, to at least partially prevent overtightening of the first plug beyond an installed position.

24. The system of claim 19, wherein a shape of the insert corresponds to a shape of the pin bore, the shape of the insert being a geometric figure having a number of sides of equal width.

25. The system of claim 24, wherein the number of sides is between three and eight.

26. The system of claim 24, wherein the number of sides is six.

27. The system of claim 19, wherein the plug bore extends through the insert from the first end to the second.

28. The system of claim 27, further comprising:

a second plug configured to be received at least partially within the second end of the insert, the second plug comprising a plate.

29. The system of claim 19, wherein the first tool body comprises an opening in a side of the first tool body, the opening configured to at least partially receive the first plug, a head of the first plug recessed in the opening of the first tool body from the side when the first plug is in an installed position.

30. The system of claim 29, wherein the head of the first plug is recessed a distance on the order of 0.25 to 0.5 inches.

31. The system of claim 19, wherein the pin bore extends from a first side of the second tool body to a second side of the second tool body, the elongate insert extending from the first side to the second side when the insert is in an installed position.

32. The system of claim 19, further comprising an elastomeric member being positioned between a first end of the second tool body and an interior portion of the first tool body.

33. A method for assembling the components of an excavation tool, comprising:

providing a first tool body having first and second tapered surfaces and first and second sides, the first and second tapered surfaces and first and second sides defining an opening converging toward a first end of the first tool body;

providing a second tool body having first and second tapered surfaces and first and second sides, the first and second tapered surfaces converging toward a first end of the second tool body, the first side comprising an opening defining a pin bore extending at least partially through the second tool body;

sliding an elongate insert into the pin bore through the opening in the first side of the second tool body;

slidably mounting the first tool body over at least a portion of the second tool body such that a recess through the first side of the first tool body aligns with the pin bore through the first side of the second tool body; and inserting a first plug into the recess of the first tool body to form a coupling between the first tool body and the second tool body.

34. The method of claim 33, further comprising:

slidably mounting the first tool body over at least a portion of the second tool body such that an opening through the second side of the first tool body aligns with the pin bore through the second side of the second tool body; and inserting a second plug into the opening through the second side of the first tool body to form a coupling between the first tool body and the second tool body.

35. The method of claim 33, wherein inserting the first plug into the opening of the first tool body comprises screwing the first plug into the opening of the first tool body.

36. The method of claim 33, wherein a shape of the insert corresponds to a shape of the plug bore, the shape of the insert being a geometric figure having a number of sides of equal width.

37. The method of claim 33, wherein the number of sides is between three and eight.

38. The method of claim 36, wherein the number of sides is six.

39. The method of claim 33, wherein a generally cylindrical, tapered surface of the first plug corresponds to a tapered surface of the insert adjacent the plug bore, wherein inserting the first plug into the opening of the first tool body forces the tapered surface of the first plug along the tapered surface of the insert, to at least partially prevent overtightening of the first plug beyond an installed position.

40. The method of claim 33, wherein inserting the first plug into the opening of the first tool body comprises inserting the first plug into the opening until a head of the first plug is recessed from the first side of the first tool body a distance on the order of 0.25 to 0.5 inches.

41. The method of claim 33, wherein the pin bore extends from the first side of the second tool body to the second side of the second tool body, the elongate insert extending from the first side to the second side when the insert is in an installed position.

42. The method of claim 33, wherein inserting the first plug into the opening of the first tool body comprises aligning a threaded surface of the first plug with a threaded surface of the insert adjacent the plug bore to couple the first tool body to the second tool body.

43. The method of claim 33, wherein inserting a first plug into the opening of the first tool body comprises aligning a threaded surface of the first plug with a threaded surface of the first tool body to couple the first tool body to the second tool body.

44. The method of claim 33, further comprising positioning an elastomeric member between a first end of the second tool body and an interior portion of the first tool body.

* * * * *